US005195282A

United States Patent [19]

Campbell

[11] Patent Number: 5,195,282

[45] Date of Patent: Mar. 23, 1993

[54] LOW COST-MODULAR ELEMENT HOUSING

[76] Inventor: E. Logan Campbell, 346 W. Campbell, Phoenix, Ariz. 85013

[21] Appl. No.: 471,367

[22] Filed: Jan. 29, 1990

[51] Int. Cl.[5] ..... E04H 1/00

[52] U.S. Cl. ..... 52/79.1; 52/233; 52/280; 446/115; 446/127

[58] Field of Search ..... 52/79.1, 79.9, 281, 52/282, 309.13, 309.14, 309.15, 233, 236.3, 283, 299, 309.1, 79.12, 79.13, 586, 593, 637, 645, 745, 280; 446/106, 115, 127, 496, 477

[56] References Cited

U.S. PATENT DOCUMENTS

| | | | |
|---|---|---|---|
| 637,212 | 11/1899 | McCune | 446/127 X |
| 1,437,867 | 12/1922 | Sixta | 446/127 |
| 1,863,995 | 6/1932 | Ponstingl | 446/127 X |
| 1,898,297 | 2/1933 | Fox | 446/127 X |
| 2,473,018 | 6/1949 | Edwards | 52/593 X |
| 2,691,242 | 10/1954 | Young | 446/115 |
| 2,712,678 | 7/1955 | Jensen | 52/233 |
| 2,841,919 | 7/1958 | McNeill | 446/115 |
| 3,132,443 | 5/1964 | Kuhn | 446/127 X |
| 3,473,273 | 10/1969 | Gunkel | 52/79.1 |
| 3,562,988 | 2/1971 | Gregoire | 52/586 X |
| 3,791,082 | 2/1974 | Bowling | 52/79.1 |
| 3,800,494 | 4/1974 | Hall et al. | 446/127 X |
| 3,862,534 | 1/1975 | Coletti | 52/79.1 X |
| 3,971,172 | 7/1976 | Gentil | 52/79.9 X |
| 3,995,402 | 12/1976 | Parenteau | 52/282 X |
| 4,034,527 | 7/1977 | Jalasjaa | 52/233 |
| 4,089,144 | 5/1978 | Astl | 52/586 X |
| 4,144,692 | 3/1979 | Jonas | 52/79.1 X |
| 4,171,591 | 10/1979 | Fischer | 446/127 |
| 4,183,185 | 1/1980 | Farge | 52/280 X |
| 4,258,511 | 3/1981 | Strain | 52/79.1 |
| 4,269,006 | 5/1981 | Larrow | 52/79.1 |
| 4,432,590 | 2/1984 | Lawrence et al. | 52/281 X |
| 4,458,461 | 7/1984 | Holley | 52/282 X |
| 4,485,598 | 12/1984 | Guardiani | 52/79.1 |
| 4,584,801 | 4/1986 | Weinberger | 52/299 X |

FOREIGN PATENT DOCUMENTS

| | | | |
|---|---|---|---|
| 959617 | 12/1974 | Canada | 52/233 |
| 644712 | 10/1928 | France | 52/233 |
| 1400050 | 4/1965 | France | 52/79.1 |
| 2559182 | 8/1985 | France | 52/79.1 |
| 2575505 | 7/1986 | France | 52/79.1 |
| 2597527 | 10/1987 | France | 52/79.1 |
| 2614053 | 10/1988 | France | 52/79.1 |
| 37752 | 8/1923 | Norway | 52/233 |

*Primary Examiner*—Renee S. Luebke
*Assistant Examiner*—Suzanne L. Dino
*Attorney, Agent, or Firm*—James F. Duffy

[57] ABSTRACT

What has been disclosed are the means and method for erecting a structure of preformed, interlocking structural elements which may be assembled by unskilled workmen. The preformed structural elements are provided in selected color and texture and include insulative coating surfaces. The interlocking mating configurations of the preformed elements assure a structure whose elements are assembled plumb and true by virtue of their longitudinal axes intersecting orthogonally. The erection of offices, storage, and housing facilities is envisioned utilizing such preformed structural elements. The low cost of materials and the ability to erect structures utilizing the efforts of local, unskilled labor responds to existing immediate needs for housing and other building facilities.

12 Claims, 9 Drawing Sheets

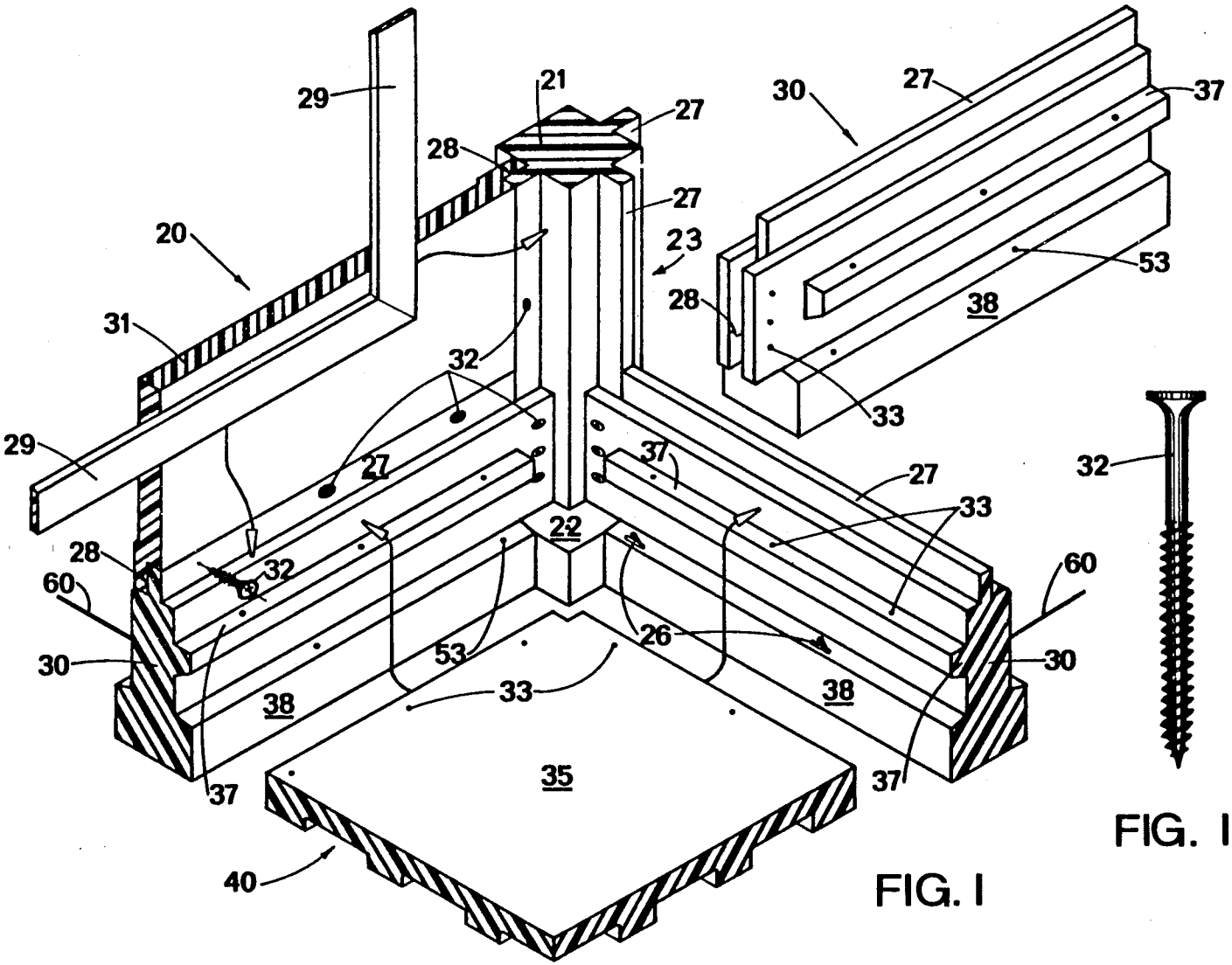
FIG. IA
FIG. I

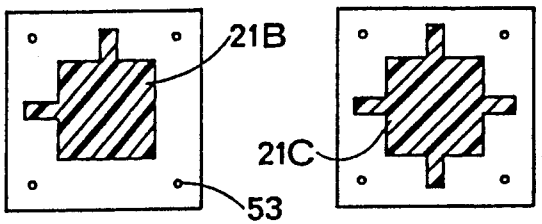
FIG. 7
FIG. 8
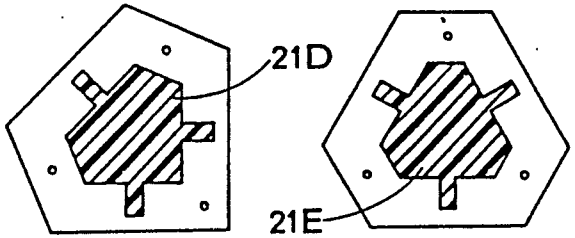
FIG. 9
FIG. 10
FIG. 11
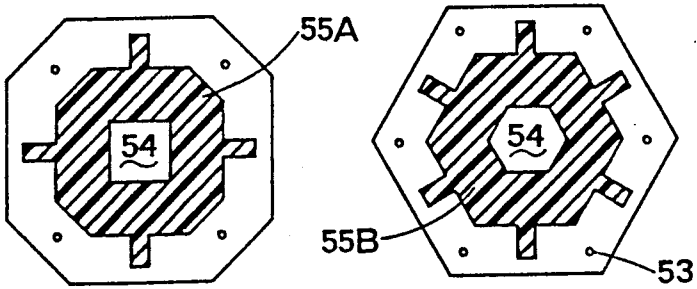
FIG. 12
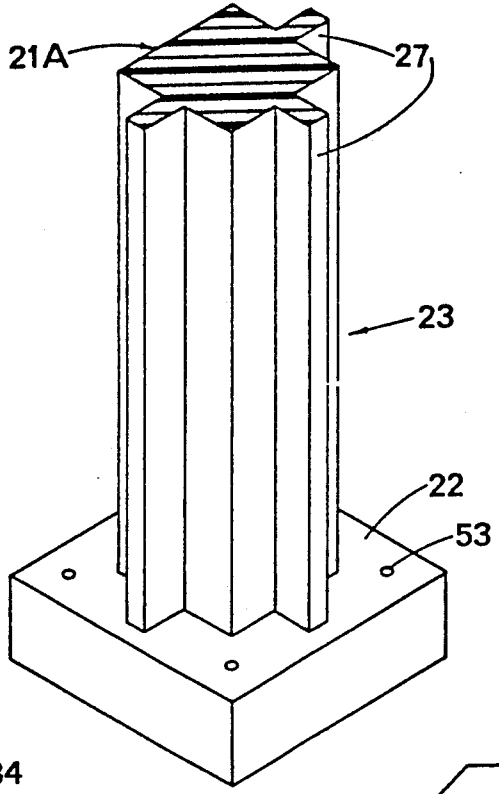
FIG. 6
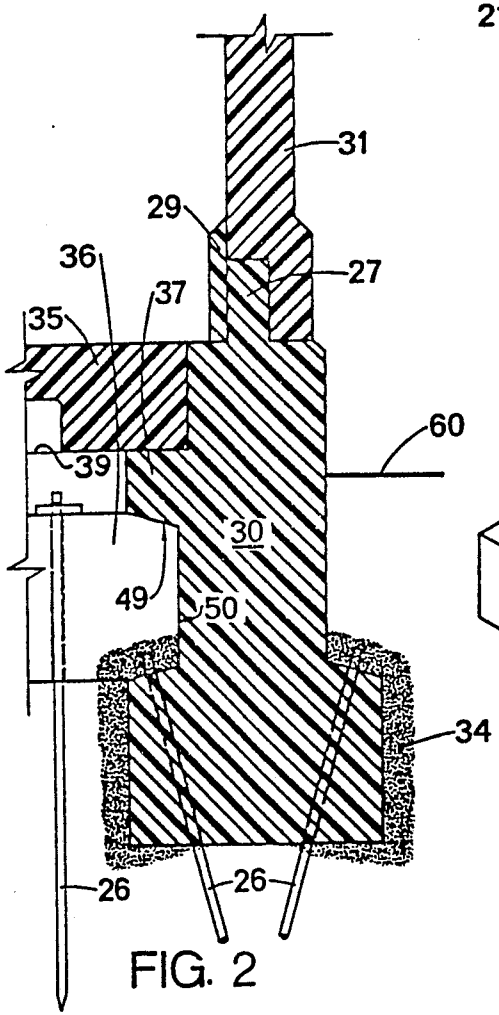
FIG. 2

LOW COST-MODULAR ELEMENT HOUSING

BACKGROUND

1. Field of the Invention

The invention relates to the field of low cost, modular building structures. In particular, the invention relates to housing which will satisfy the needs of third world countries and cities having high populations of homeless people. Specifically, the invention relates to building structures in which all elements; for example, walls, floors, ceilings, windows, door and structural beams; are provided as prefabricated modular elements configured so as to matingly engage, one to another, for assembly of a building structure by unskilled labor.

2. Prior Art

A poorly built home is a constant irritant. Walls do not meet at right angles making cabinetry and wallpapering a major task. Properly hung shelving and pictures appear to hang crookedly when floors and ceilings are not parallel or walls are not plumb. Floors that incline contribute their own wealth of annoyances.

Such nuisances often arise when one purchases an antique home in which the foundation has settled in a way so as to cause dimensional distortions within the building structure. However, such problems assume the role of major irritants when they are encountered in newly built structures. Then, they signal the incompetence of the workmen involved in the building of the structure. The self-built home of the first-time builder is often an example of this as evidenced by the wry statement to the effect frequently made by such a builder, "I learned a lot when I built this house. There are mistakes here I'll never make again."

To avoid such problems, the erection of buildings is generally reserved for skilled craftsmen in the building trades. Because a man is worthy of his labor, the costs of providing properly constructed housing for the indigent homeless in the Unites States, as well as in other countries of the world, is often beyond the budgetary constraints experienced by local and national governments. It is the intent of this invention to provide the means and method leading to low cost building construction wherein inexpensive, unskilled labor, directed by a skilled foreman, is exclusively employed. The materials utilized will be of low cost so as to bring the buildings within the budgetary availability of governments, and governmental agencies seeking to meet the needs of indigent homeless as well as providing highly utilitarian and efficient commercial and modern living facilities.

SUMMARY OF THE INVENTION

The invention relates essentially to means and method for assembling a building of performed structural modules. The performed modules are configured such that appropriate ones will mate readily and yet be constrained in that mating to assume desired structural and angular relationship. Thus, vertical columns and horizontal beams will, by reason of the mating configurations, join each other such that their longitudinal axes will intersect orthogonally. An enclosed area made up of a plurality of beams, each end-coupled to a column, will define a horizontal plane when those columns are vertical. Wall enclosures, matingly coupled to such beams and columns will, by reason of the coupling of the mating configurations, hang plumb and intersect adjacent wall enclosure units at angles anticipated by the designer, again because of the mating of the coupling configurations.

Because these preformed, matingly configured structural elements assemble so easily, a building may be accurately and swiftly erected utilizing only unskilled labor and an experienced foreman. The assembly may be further facilitated by the use of predrilled holes in the various structural elements which come into alignment at the time of assembly. Adhesive coated locking pins inserted into these aligned holes secure the assembly with minimal effort on the part of the workmen.

Assume that there are four columns to accept vertical and lateral load forces of a building and an additional four footer beams to be used as a load bearing footing for a building. If each of the four columns is coupled to two footer beams such that a square enclosure results, that enclosure will define a horizontal plane when the columns are vertical. Since the complementary mating configurations existing on column and beam assure that the beam and column will join at right angles, the beam is forced to lie in a horizontal plane when the column is vertical. Thus, with the establishment of the first column vertically within the ground, the mating configurations on the elements force the footer beams to lie in a horizontal plane. When a flooring structural module is coupled to the footer beams, again utilizing mating coupling configurations, the floor must, of necessity, lie in a horizontal plane as well. A wall enclosure module matingly coupled by reason of its configuration to columns and footer beams will, again by reason of those mating configurations, be at right angles to the floor and therefore will lie in a vertical plane.

The addition of four header beams matingly configured and coupled to the columns, as well as to the wall enclosure elements, assures that the header beams will lie in a horizontal plane and the enclosure defined by the four header beams will itself define a horizontal plane. Above this second horizontal plane, defined by the header beams, a ceiling/roof module is emplaced. The ceiling/roof module is coupled to the header beams and has a complementary mating configuration to permit its coupling to adjacent ceiling/roof modules.

Buildings of various types are envisioned by the disclosure, including homes, offices, commercial buildings, warehouses, and covered structures without walls. The material chosen to exemplify the manufacture of the molded or extruded preformed structural elements is polyurethane. The polyurethane may be filled with various media to increase its strength, insulation, and fire resistance. Coatings may be included as part of the molding operation or sprayed on after extrusion to increase the ultra-violet resistivity of the material, to add color and texture, and to further increase the insulation characteristics of the structural elements.

DESCRIPTION OF THE DRAWINGS

FIG. 1 is a partially exploded sectional view of a portion of the assembly of a low cost modular building structure.

FIG. 1A illustrates a typical screw fastener utilized throughout the assembly of the structure.

FIG. 2 is a side sectional view of the footer beam within the earth, a spanner beam for supporting the floor and a wall section atop the footer beam. The anchoring of the footer beam and the grade beam into the earth is also illustrated. A foamed grout is employed to fill voids beneath the footer and grade beams and the earth.

FIG. 3A illustrates a typical anchor pin used to anchor various structural base elements to the earth.

FIG. 6 is a perspective view, of a section of a column and its base. The column illustrated has three tangs disposed about the column of 90° intervals.

FIG. 7 is a top sectional view of a column having two tangs orthogonal to each other.

FIG. 8 is a cross sectional view of a column having four tangs orthogonal to each other.

FIG. 9 is a cross sectional view of a column having three tangs only two of which are orthogonal.

FIG. 10 is a cross sectional view of a column having three tangs disposed at 120° intervals with respect to each other.

FIG. 11 illustrates a column, with four orthogonal tangs, having a riser for the passage of wiring or plumbing coincident with its central axis.

FIG. 12 is a cross sectional view of a column having six tangs disposed at 60° intervals and a central riser.

FIG. 13A illustrates the ditching pattern in which ditches are dug to accommodate the footing and grade beams of the structure.

FIG. 13B is a perspective view showing the columns, footer beams, and spanner beams in place within the ditching pattern established by FIG. 13A.

FIG. 13C illustrates the addition of the flooring modules atop the footer and spanner beams of FIG. 13B.

In FIG. 13D, the header and spanner beams have been added to the illustration of FIG. 13C.

In FIG. 13E, exterior and interior walls have been erected and windows and doors emplaced within the structure of FIG. 13D. The ditchings about the footings have been filled in as well.

FIG. In FIG. 13F, the ceiling/roof modules have been emplaced upon the structure of FIG. 13E so as to complete the structure.

FIG. 15A is the floor plan of a structure having neither water, toilet nor cooking facilitates therein. This floor plan provides basic, but comfortable, accommodations for living and storage of personal effects.

FIG. 15B illustrates the same floor plan of FIG. 15A but having modern conveniences associated with indoor plumbing and electricity.

A DETAILED DESCRIPTION OF THE INVENTION

Figure 3:
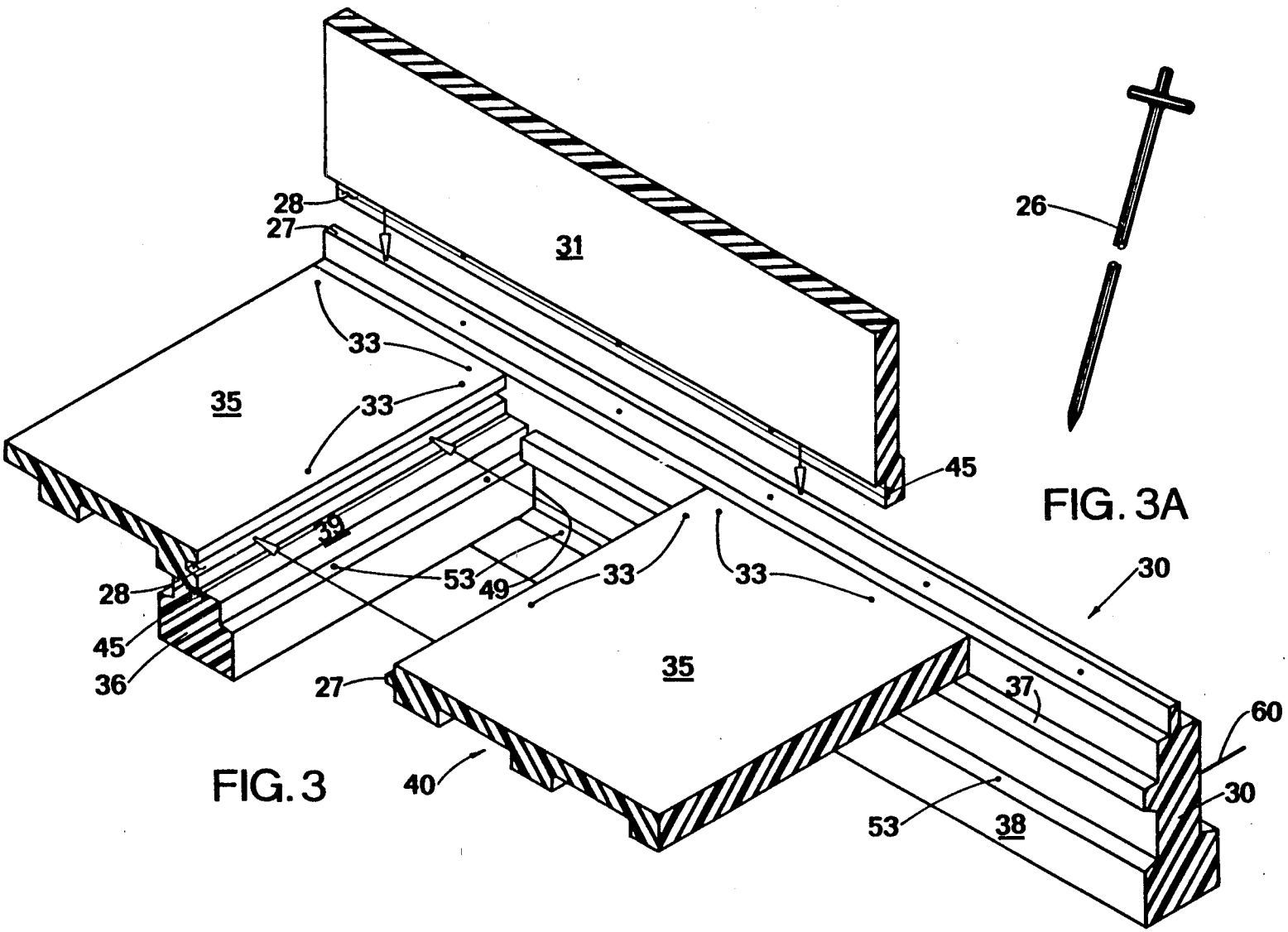
FIG. 3 is a partially exploded, sectional view illustrating the placement of floor sections on the footer and grade beams and the joining of a wall section to the footer beam.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

About to be disclosed herein are the means and method for fabricating a low cost building. To this end, all of the structural elements of the building are provided as preformed modulator elements. These structural elements will be molded, or extruded, or both. By way of exposition and not of limitation, the structural elements disclosed herein are exemplified as being polyurethane possibly ad-mixed with a filler material, for example, rice hulls. Such fillers would be utilized to decrease the weight of the structural elements and improve insulation and fire retardant characteristics of the structural elements.

Ultra-violet resistant protection, fire retardants and insulative materials may be applied to the elements at the time of their molding. Should the elements be extruded, these adjuncts may be spray applied to the elements after their extrusion.

Barrier Systems, Inc. of Cleveland, Ohio has a STAYTEX Insulation System which can be utilized, for example, to provide color and texture to the interior surfaces of a structure utilizing the structural elements disclosed herein. Their Staytex 4119A provides a seamless surface coating which adds to the insulation and attractiveness of the interior.

Foam Enterprises, Inc. of Minneapolis, Minnesota markets a Futura SIM ultra-violet coating which comes in various colors and textures for application to the exterior surfaces of the building elements during the course of their molding or for spray application after extrusion of the elements.

All structural support elements disclosed herein will be matingly configured to permit their mating in an interlocking manner which virtually precludes the necessity to utilize skilled labor and which assures plumb and true junctions of structural elements as their longitudinal axes intersect orthogonally.

FIG. 1 illustrates the interlocking nature of a portion 20 of an assembly of a structure. A molded or extruded column 21 provides vertical and lateral support. Column 21 is affixed to a base 22 which, in the course of construction, is set into the ground below grade level 60. Chosen for illustration is a column 21 having three projections or tangs 27 displaced about column 21 at 90° intervals. Tangs 27 are provided to mate with other structural elements to be herein disclosed.

To the upper right of the illustration of FIG. 1, removed from its nominal mating position with a tang 27 on column 21, is a footer beam 30. The left-most end of that footer beam 30 is configured such that groove 28 mates with a tang 27 on column 21 while base 38 of footer beam 30 comes into intimate contact with base 22 of column 21. Column 21 and its base 22 will herein be referred to as column unit 23.

FIG. 1 further illustrates two footer beams 30 matingly assembled to column unit 23. The mating of the two footer beams 30 with column unit 23 disposes the footer beams at right angles to each other. Because the elements such as column unit 23 and footer beams 30 are all performed, each unit having its selected length, the assembly of a multiplicity of column unit 23 and footer beams 30 assures orthogonality of mating structural elements. Mating of floors and walls, in an interconnected, mated sequence, will further assure proper angular relationship between structural elements and the erection of a building structure which is plumb and true.

A section of a wall element 31 is shown in FIG. 1 having a mating groove 28 coupled to a tang 27 of column 21 and a second mating groove 28, along the lower edge of wall 31, mating with tang 27 on a footer beam 30 extending toward the lower left of FIG. 1. The joining of tangs 27 with coupling grooves 28 of wall 31 further assures a rigid, true, and plumb structure.

As an optional convenience, drill indices 33 are dimpled into the preformed structural elements in the course of their molding or extrusion. Drill indices 33 provide a dimpled index for drilling a starter hole to accept a screw fastener 32. When the assembly is matingly coupled and then screw fastened together, a very strong, stabile structure results. By way of example, screw fasteners 32 may consist of quarter inch shank, tempered steel drywall screws of approximately 5½ inches in length. The use of fasteners of this type assures the strength of the structure and facilitates the installation procedure. Battery powered drills and screw drivers may be employed in the course of the construction. Drywall screw fasteners of the type suggested are illustrated in FIG. 1A. To conceal the screw head, visible about the periphery of wall 31 in the assembled structure, a decorative trim strip 29 is provided.

In an embodiment which may prove to be preferred, after further testing, the drill indices 33 will instead be pre-drilled alignment holes creating an aligned bore when the various structural units are coupled together by joining the complementary mating configurations. These pre-drilled holes 33 will be held in alignment by the insertion of a rod as an alternative to screw fastener 32. The assembled structural elements, as well as the rod substitute for screw fastener 32, may be coated with a construction type adhesive used in concrete construction work for coupling lifting rings and the like to heavy concrete slabs. An example of such commercial adhesive is the polyester resin sold by Kelken-Gold, Inc. of South Plainfield, N.J. under the trademark KELIBOND. They also provide KELIBONDANCHORS as studs for insertion in holes 33. These studs replace screw fasteners 32.

To further stabilize the structure, anchor pins 26, FIG. 3A, are driven through the various base elements and into the earth beneath. Such use is suggested in FIG. 1 and is seen in the cross sectional illustration of FIG. 2. Typically, anchor pins 26 would be spaced approximately four feet on center in staggered rows on either side of the base elements.

Each of the footer beams 30 has a floor supporting abutment 37. A preformed flooring element 35 is positioned atop abutments 37 and fastened with screw fasteners 32 located in screw indices 33. The underside of flooring sections 35 has a waffle configuration 40 to provide a high strength-to-weight ratio. In general, flooring sections 35 will be supported on three sides by footer beam abutments 37. The remaining fourth side of flooring sections 35 will be supported atop a grade beam 36 placed in supporting contact beneath two flooring sections 35 along the juncture at which the two flooring sections mate. This arrangement is illustrated in FIG. 3.

FIG. 3 is a partially exploded sectional view illustrating two flooring sections 35. The flooring section 35, further to the left of the illustration, is partially supported by abutment 37 on footer beam 30 and by support surface 39 of grade beam 36. That flooring section 35 is provided with a coupling groove 28. A second flooring section 35, illustrated closest to the viewer, is partially supported by abutment 37 and is about to be positioned so that its tang 27 will engage in coupling groove 28 and achieve additional support on surface 39 of grade beam 36, when tang 27 and coupling groove 28 of flooring sections 35 are mated. Screw fasteners 32 may be utilized at the positions indicated by indices 33 to affix floor sections 35 to grade beam 39.

The groove 45, depicted in FIG. 3 along the surface 39 of grade beam 36, is intended to accept an expandable sealing compound. Further disclosure as to this sealing compound will await the discussion of the placement of the roof elements on the structure.

The illustration of FIG. 3 also indicates the manner in which a coupling groove 28 in wall section 31 matingly engages tang 27 of footer beam 30.

Figure 13D:
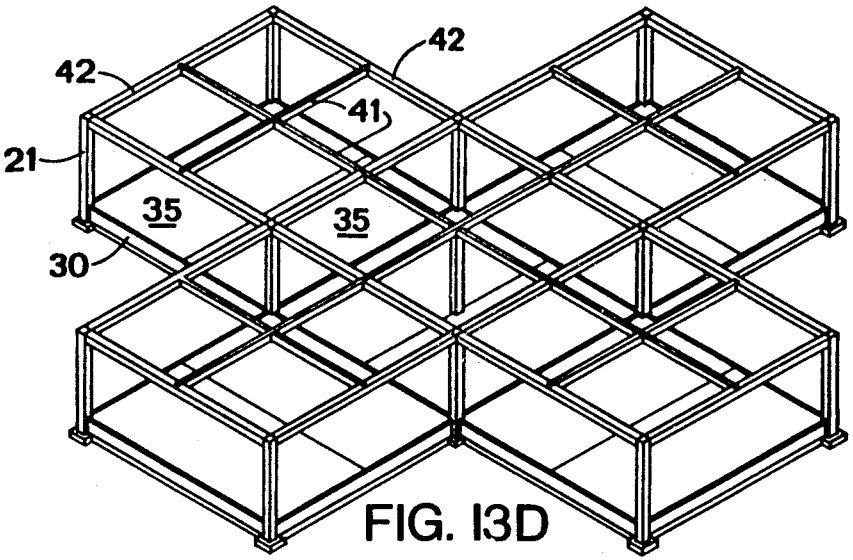
FIGS. 13A–F illustrate in sequence the assembly of a building structure built in accord with the teachings herein.

Footer beams 30 and grade beams 36 are positioned below grade 60 in a grid of ditches 24, illustrated in FIG. 13A. The cross sectional view of FIG. 2 shows footer beam 30 and grade beam 36 anchored by anchor pins 26. A well section 31 and a floor section 35 are coupled to the footer beam 30. A grade beam 36 has an end 49 supported within a coupling groove 50 of footer beam 30. The floor section 35 is supported by the supporting surface 39 of grade beam 36. To assure a uniform consistent loading between the bases of footer beam 30 and grade beam 36 with the ground beneath, a foamed grout 34 is utilized to fill in any voids between the beams and the ground surface.

Figure 4:
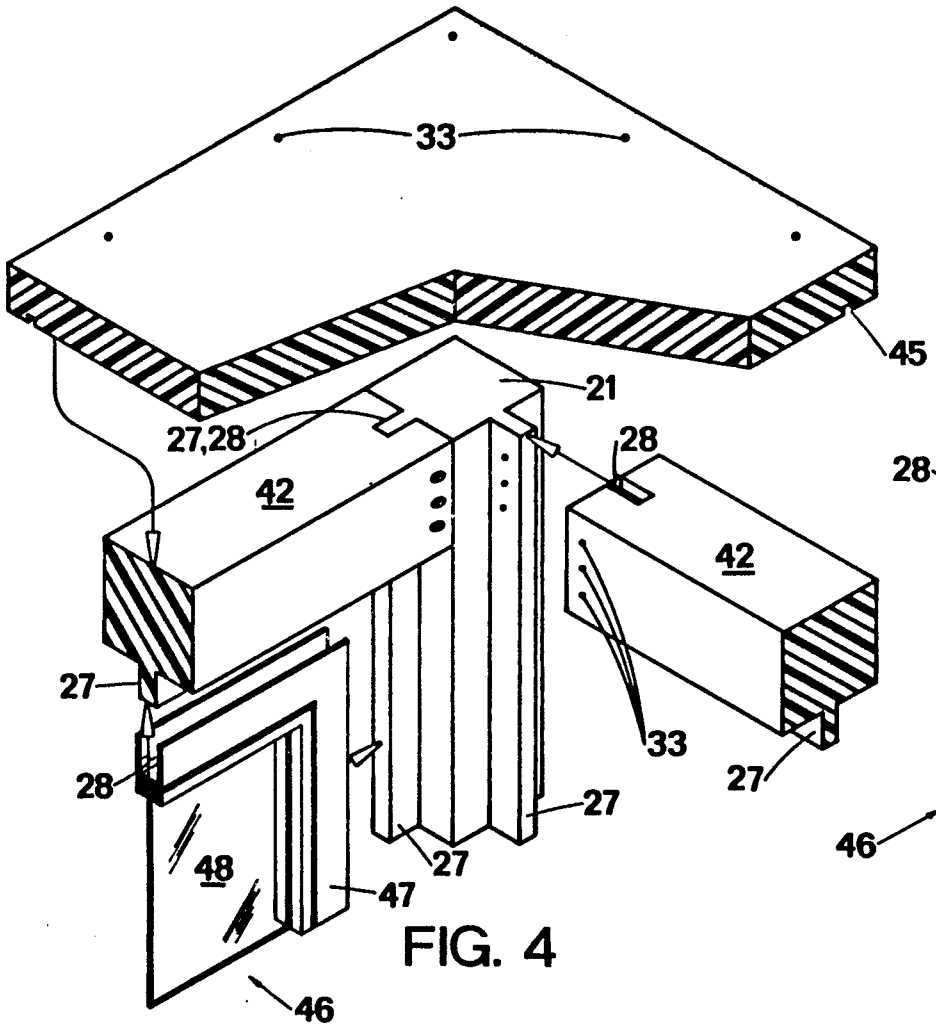
FIG. 4 is an exploded-sectional view, in perspective, looking down toward the ceiling to the joining of header beams windows and ceiling.

Header beams 42 define the upper support structures and are coupled to columns 21 in the manner indicated in FIG. 4. As with the footer beams 30, header beams 42 have coupling grooves 28 to mate with tangs 27 of column 21. A ceiling/roof module 43 is set in place atop header beams 42 and column 21. In place of a structural wall section 31, a window assembly 46 may be inserted. In FIG. 4, window assembly 46 is seen to comprise window glazing 48 set within a frame 47. Frame 47 is provided with coupling grooves 28 which couple matingly with tangs 27 of header beam 42 and column 21.

Figure 5:
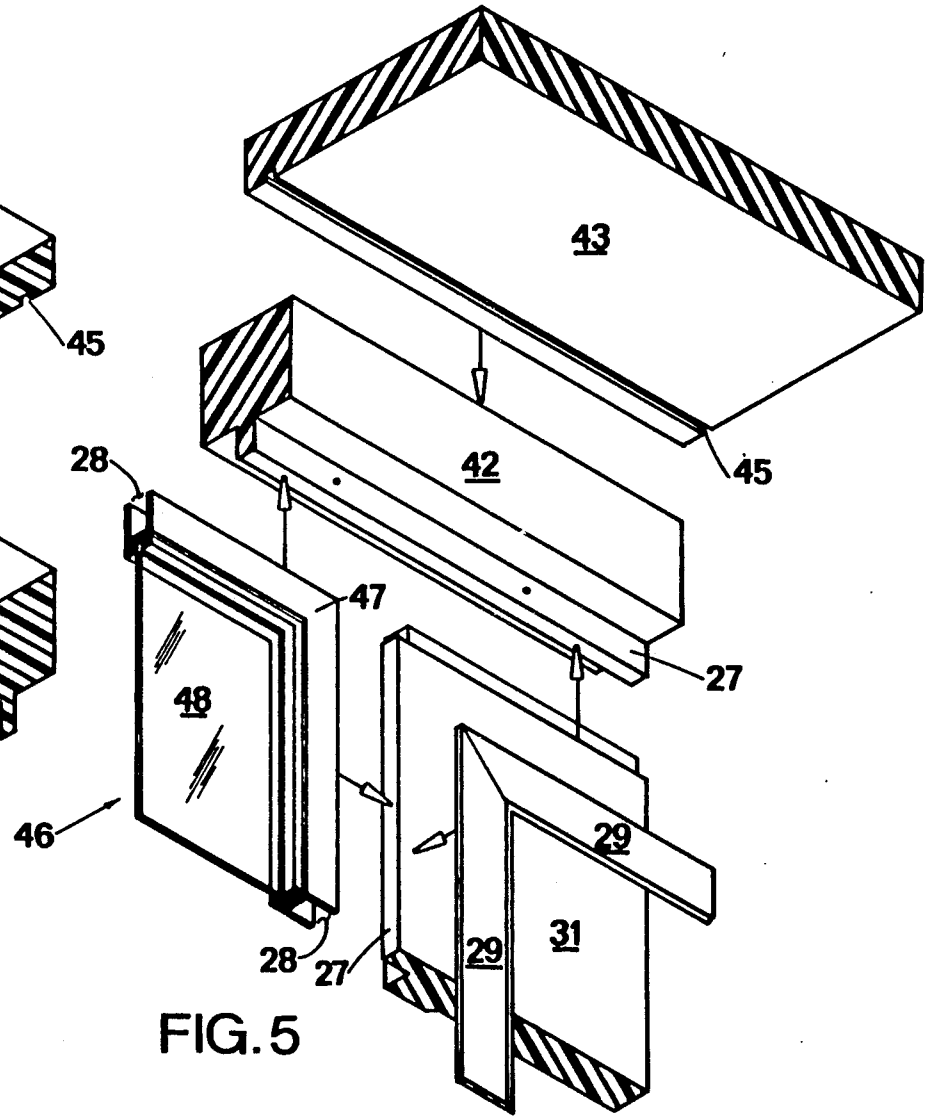
FIG. 5 is an exploded sectional perspective view, somewhat similar to FIG. 4, but looking upward toward the ceiling.

In the exploded sectional perspective view of FIG. 5, the viewer is looking upward toward ceiling/roof module 43. The groove 45, seen clearly in the undersurface of ceiling/roof module 43 in tended to accept a joint sealing compound to seal the juncture between ceilings/roof element 46 and the upper surface of header beam 42. Such a seal, a Johns Manville product, produced by Emseal Joint Systems Limited, of Standford, Conn., is designed for insertion in a groove, such a groove 45, where, after assembly of ceiling/roof module 43 and header beam 42, the seal expands to create a positive pressure seal along the length of groove 45 and between the two mating elements 43 and 42.

FIG. 5 also illustrates the manner in which window assembly 46 is coupled to a wall section 31. Wall section 31 is provided with a coupling tang 27 to couple with the coupling groove 28 in window frame 47. As noted in FIG. 1, a decorative trim 29 is utilized to conceal the head of the screw fasteners 32 employed at screw indices 33.

Figure 5B:
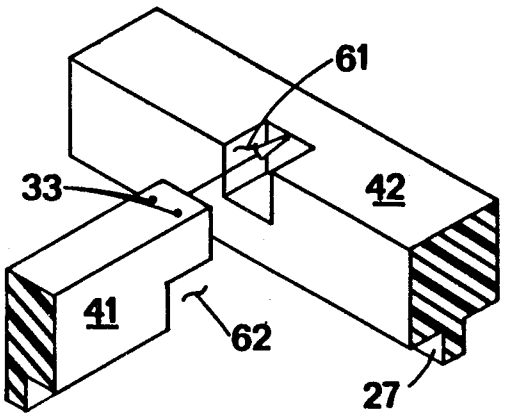
FIG. 5B is a sectional detail of the manner in which a spanner beam is coupled to a header beam.
Figure 5A:
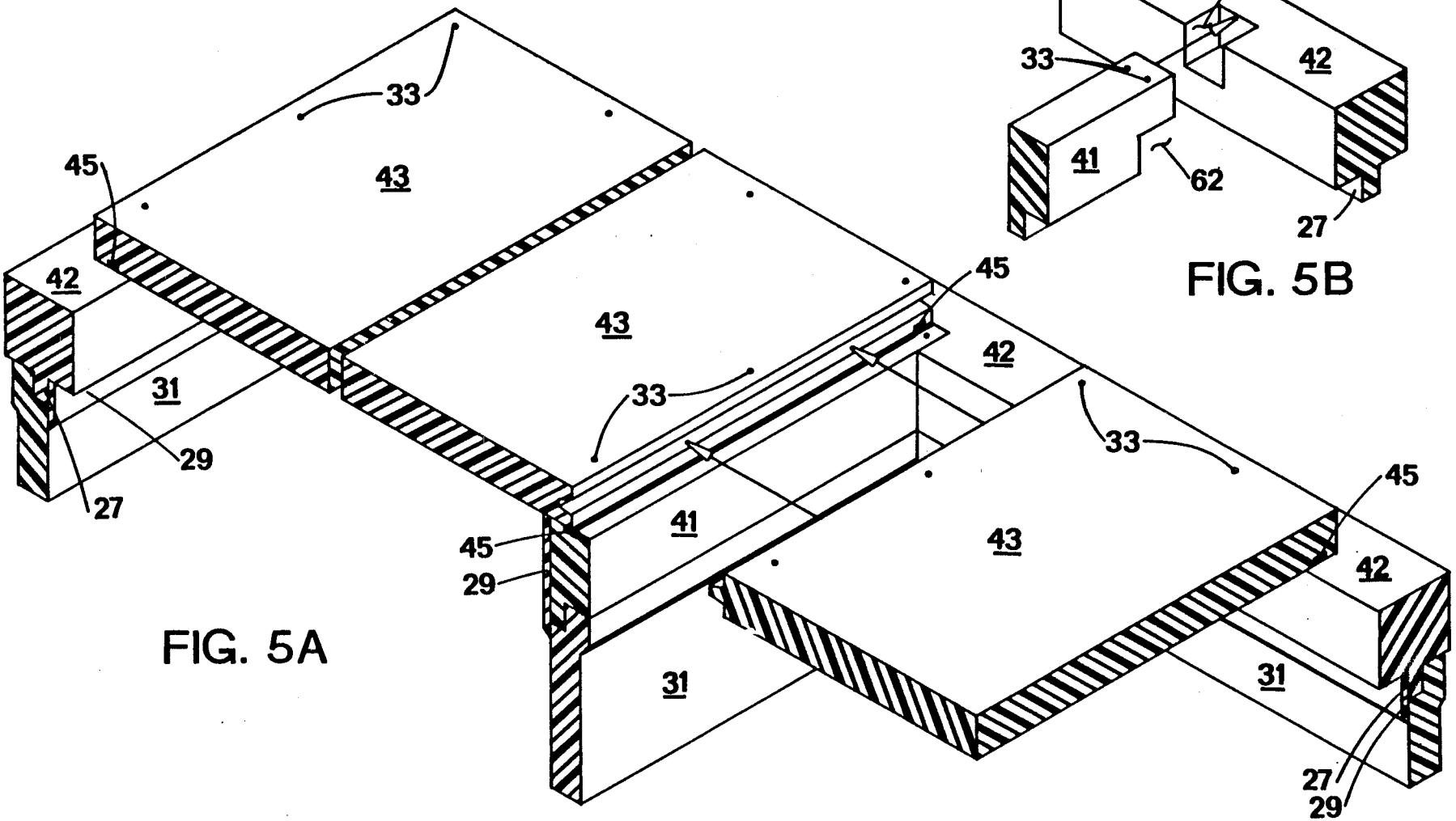
FIG. 5A is a sectionalized perspective drawing showing the manner in which adjacent ceiling/roof modules are coupled to one to the other as well as the manner in which these modules are supported by header beams and spanner beams.

FIG. 5A is a sectionalized, perspective, assembly drawing illustrating the emplacement of ceiling/roof modules on top of header beams 42. A spanner beam 41 supports ceiling/roof modules 43 where modules 43 are joined together by means of the complementary mating tang 27 in groove 28. The use of spanner beam 41 in providing interior support for ceiling/roof modules 43 may be understood readily upon reference to FIGS. 13D–13F.

A well element 31 is shown matingly coupled to spanner beam 41. In this instance, wall elements 31 will form an interior wall of the structure.

In keeping with the preformed interlocking nature of the various structural elements, the detail of FIG. 5B shows the manner in which spanner beam 41 is configured to have a notch 62 permitting the distal end of spanner 41 to fit within the cutout 61 in header beam 42. Because of the interlocking nature of all the elements, the header beams 42 and the spanner beams 41 will define a horizontal plane. When planar shaped roof elements 43 are placed atop the header and spanner beams, such planar roof elements 43 will themselves form a horizontal plane. Wall elements 31, again by virtue of the complementary mating configuration of the various structural elements, will drop vertically from header 42 and join the horizontal plane of the floor at a right angle. Thus, because of the various mating configurations, all elements of the house are angularly correct and true to the designer's plans and may be so assembled without skilled labor.

To add variety to the floor plans which may be achieved utilizing the teachings herein, a variety of column unit assemblies 23 are provided. Some of these column units 23 are illustrated in the drawings of FIGS. 6–12. In FIGS. 6–10, the columns differ in the number and the angular displacement of coupling tangs 27 associated with each column. Column 21A of FIG. 6 has three tangs 27 displaced at intervals of 90°. Column 21B of FIG. 7 has two tangs oriented 90° with respect to each other. Column 21C of FIG. 8 has four tangs disposed at 90° intervals.

The three tangs of column 21D in FIG. 9 are disposed, two at 90° intervals with a third tang removed 135° from either of the original two tangs. Column 21E of FIG. 10 has three tangs angularly displaced by 120°.

To permit entry of electrical wiring and water piping, columns 55A and 55B, of FIGS. 11 and 12, respectively, are provided with a riser 54. Riser 54 is a bore extending through the length of columns 55A and 55B. The utility of such risers will be subsequently disclosed.

An example of the methodology of utilizing the preformed modular elements of the invention will now be set forth. Reference should be made to FIGS. 13A–13F. At the building site, a ditch 24 is excavated in the grid pattern illustrated in FIG. 13A. This pattern will provide a four unit structure, as will be seen. At each corner intersection of the pattern of FIG. 13A, columns 21 are set in place. So too, a column is established at the center of the pattern. Footer beams 30 are laid down and coupled to the vertical columns 21 in manner earlier described herein. Grade beams 36 are then emplaced to provide support for flooring elements 35 in regions non-adjacent to footer beams 30.

Figure 13C:
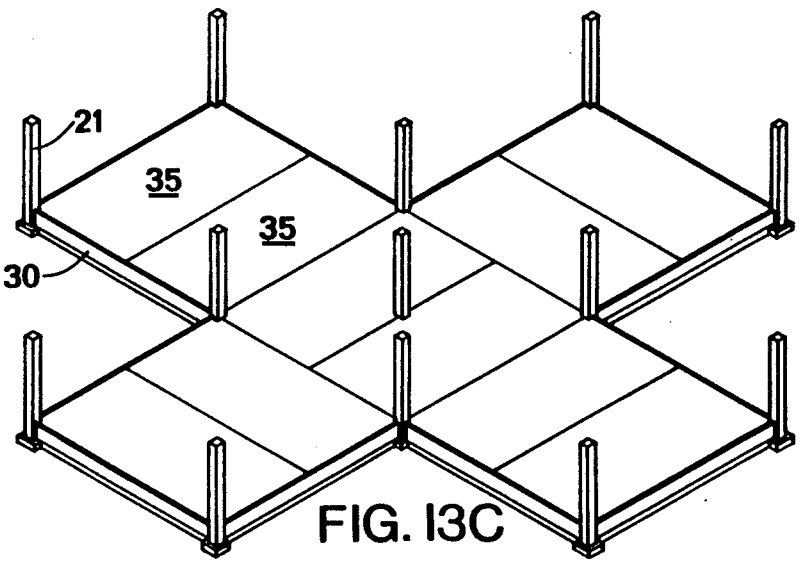
Figure 13A:
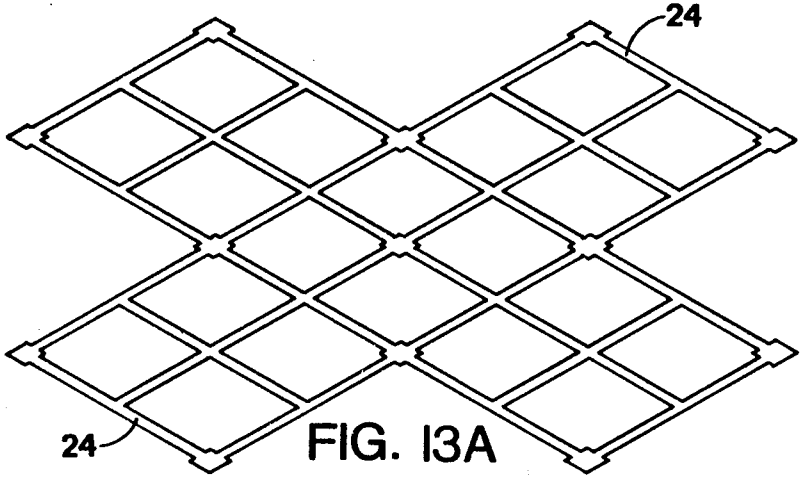
Figure 13B:
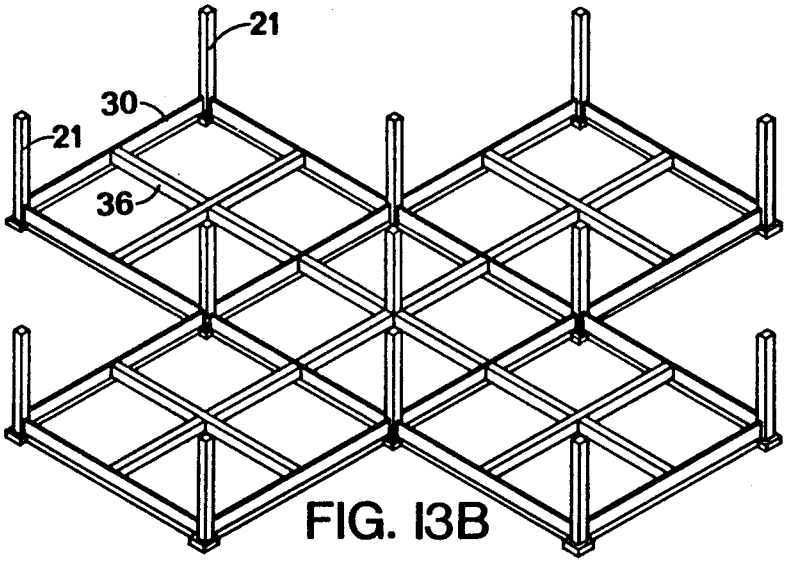
Figure 13F:
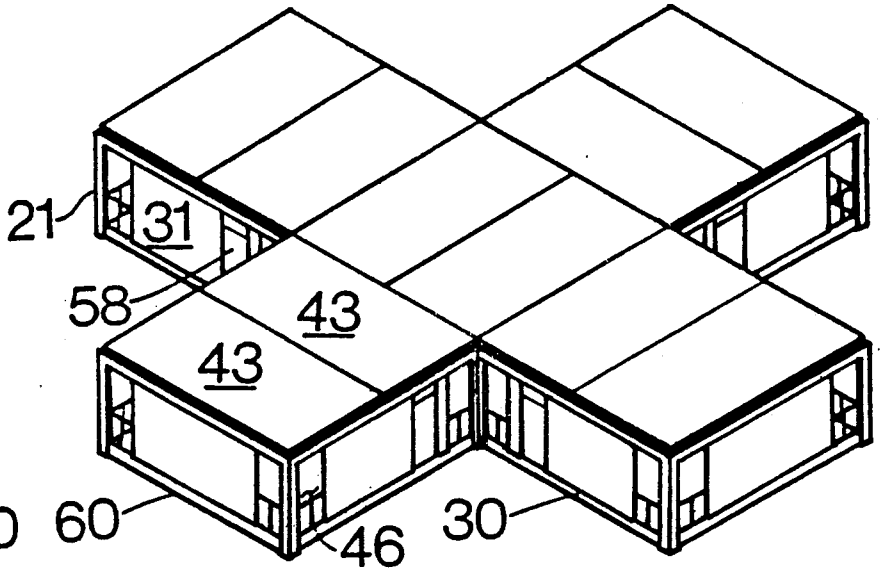

In FIG. 13C, floor elements 35 have been set in place and screw fastened in position in the manner earlier set forth. Header beams 42 and spanner beams 41 are then put into position as shown in FIG. 13D. The beams 42 and spanner beams 41 will support the ceiling/roof modules 43 at the proper point in the procedure for the installation of the roof.

Figure 13E:
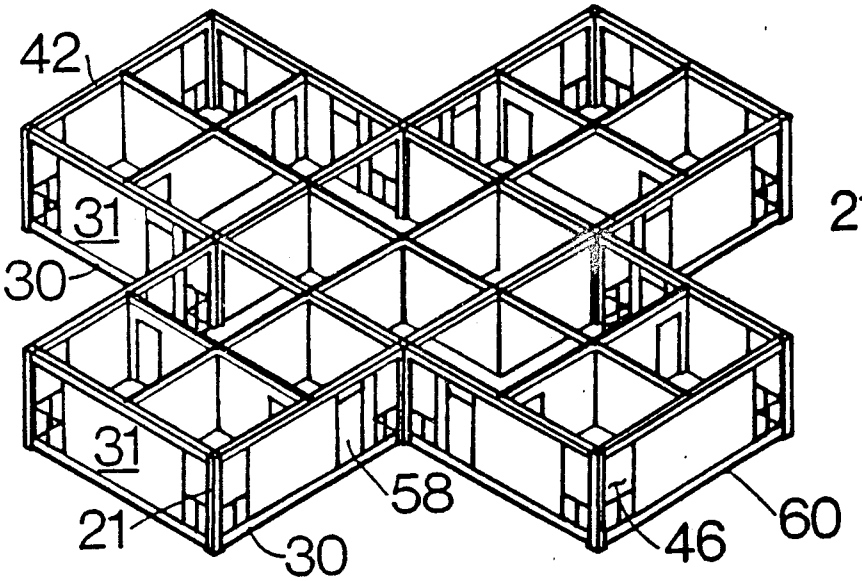

Interior and exterior walls 31 as well as doors 50 and windows 46 are added to the growing structure, as seen in FIG. 13E. The use of walls, doors and windows may hereinafter be alternatively referred to as wall enclosure modules 63. A wall enclosure module 63 may refer to a structural wall 31, a window wall 46, or door assembly 58, or the combination of any two or all of these.

Figure 14:
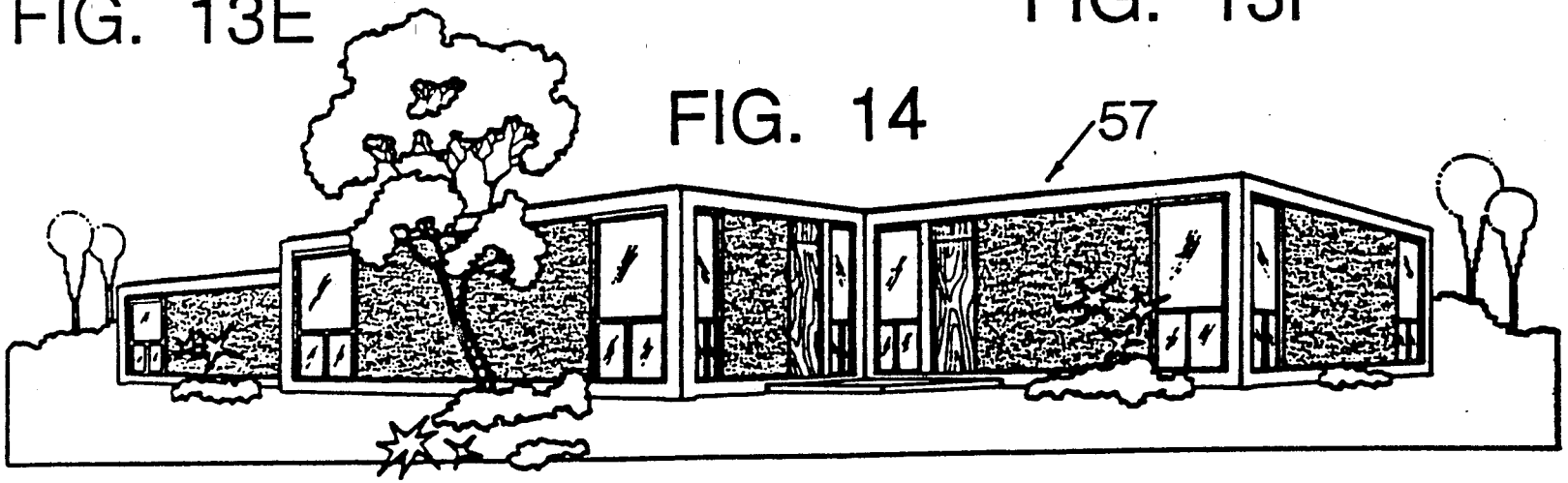
FIG. 14 is an architect's drawing of a front elevation of the building constructed in the course of the building sequence illustrated in FIGS. 13A–F.

Finally, ceiling/roof modules 43 are installed atop the structure. An architect's conceptual drawing of the resulting structure 57 is illustrated in FIG. 14.

Figure 15B:
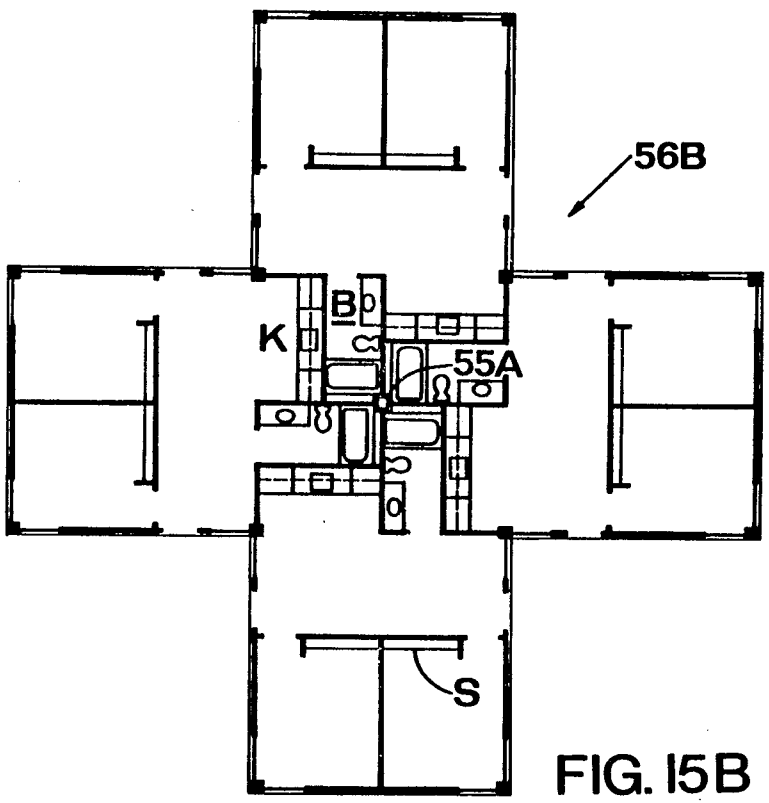
FIGS. 15A and 15B illustrate alternative floor plans for use in the structure of FIG. 13F.
Figure 15A:
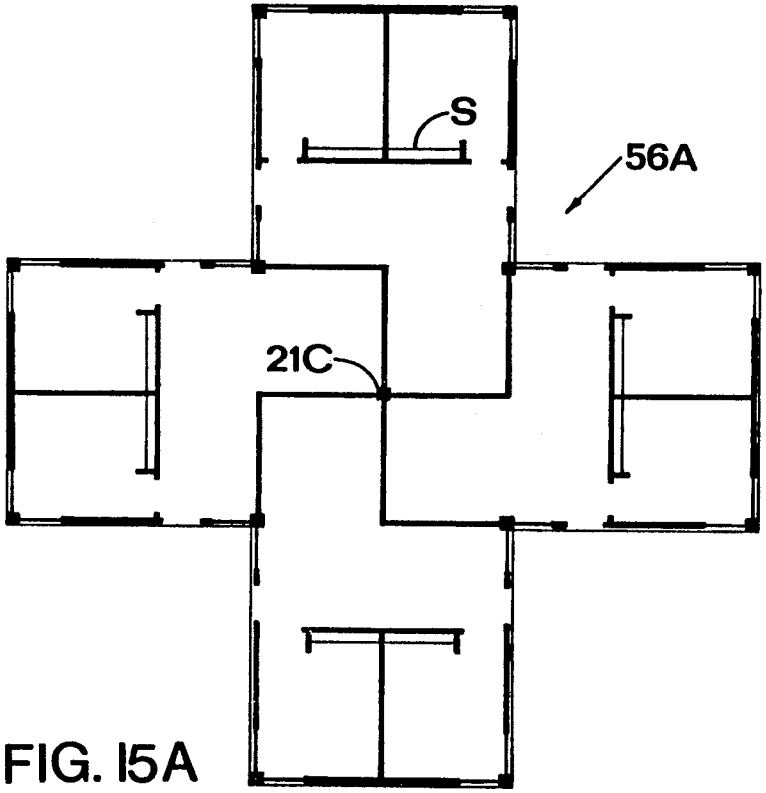
Figure 15C:
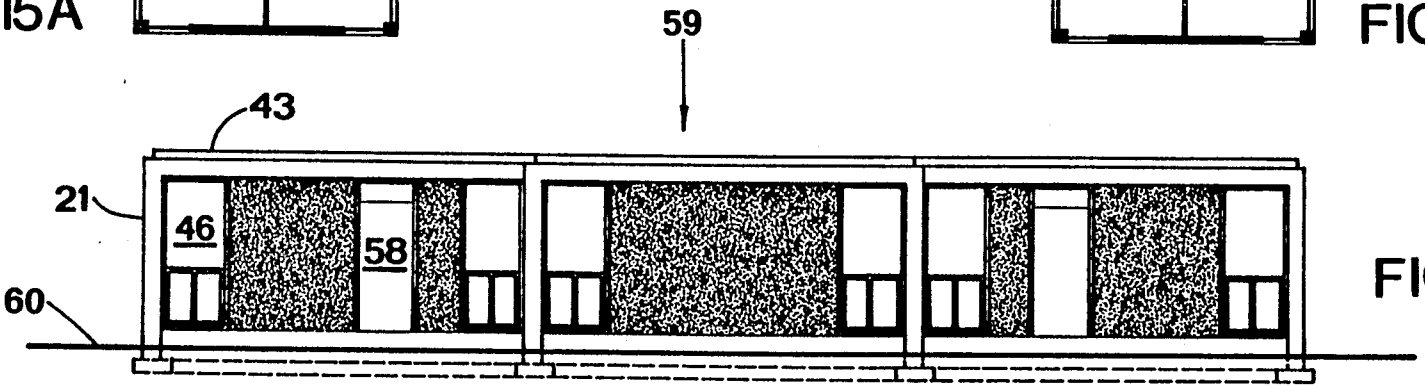
FIG. 15C is a front elevation view of the structure housing either of the floor plans illustrated in FIGS. 15A or 15B.

Two alternative floor plans, 56A and 56B, are illustrated in FIGS. 15A and 15B, respectively. The building structure of either floor plan is represented by the front elevational view shown in FIG. 15C.

FIG. 15A provides four housing units such as may be used in regions wherein group cooking and bathing facilities, separate from housing facilitates, are utilized. The floor plan 56A provides simple accommodations only, with rooms for living and sleeping and some storage facilities S. The central column 21C of floor plan 56A does not have a riser through it. The floor plan does not include the use of a power and water utilizes supply.

Figure 16B:
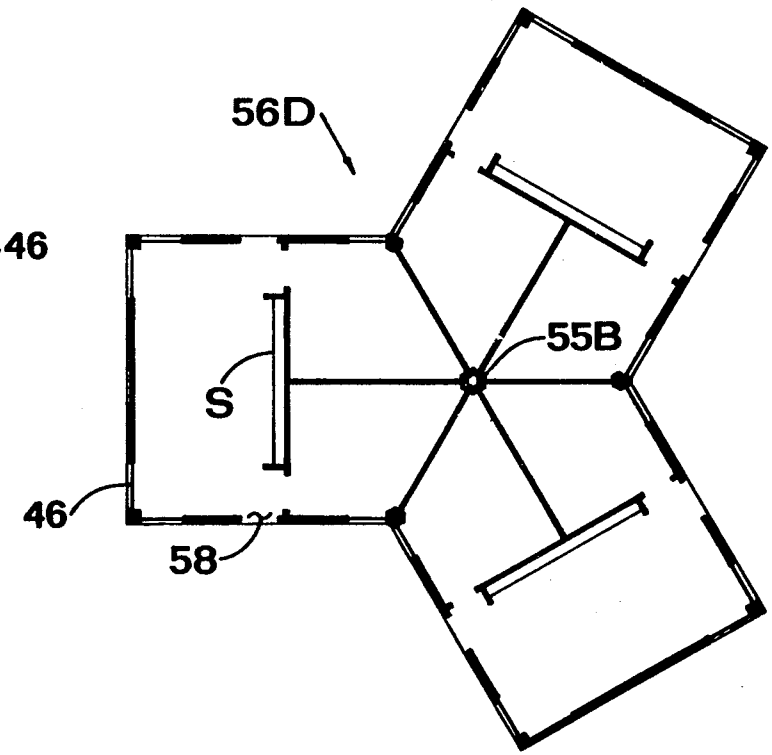
FIG. 16B is the floor plan of a tri-plex building assembly which may be constructed in accord with the teachings herein.
Figure 16A:
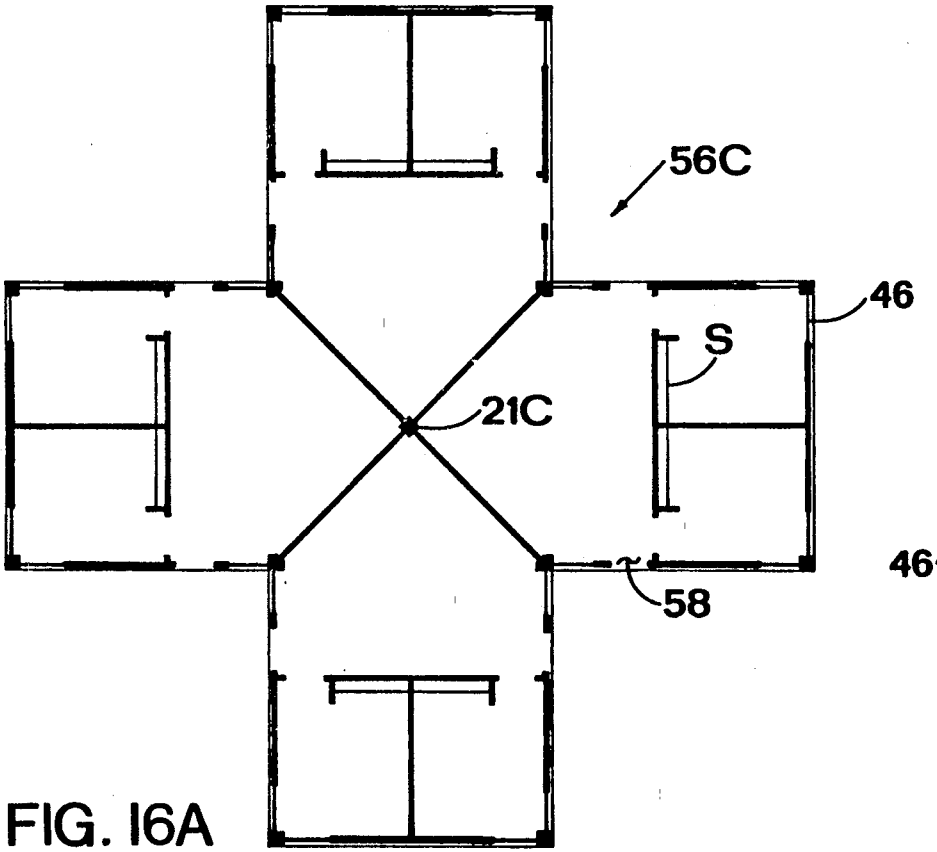
FIG. 16A illustrates an alternative to the quadra-plex building unit illustrated in FIGS. 13 through 15.

Floor plan 56B of FIG. 15B utilizes a central column which has a riser 55A through its central axis to provide for entry of water and power lines. Floor plan 56B provides a kitchen K and a bath B in each of the four housing units. As with the earlier plan, simple closest and shelving storage facilities S are provided. Other, alternative, floor plans 56C and 56D are illustrated in FIGS. 16A and 16B. These floor plans are provided as an illustration of the versatility of the structures that may be constructed utilizing the performed modular elements of the invention and the variety of column units 23 available, FIGS. 6–12.

While it has not been illustrated herein, the invention conceives of the use of radiant heating with performed fluid flow channels cast within the structural elements. Preliminary cost analysis of the materials required for the construction of a building having either of the floor plans illustrated in FIGS. 15A and 15B indicate that the building structure of FIG. 15C could be built at a material cost of less than $10 a square foot utilizing the means and methods set forth herein.

What has been disclosed are the means and method for erecting a structure of preformed, interlocking structural elements which may be assembled by unskilled workmen. The preformed structural elements are provided in selected color and texture and include insulative coating surfaces. The interlocking mating configurations of the preformed elements assure a structure whose elements are assembled plumb and true by virtue of their longitudinal axes intersecting orthogonally. The erection of offices, storage, and housing facilitates is envisioned utilizing such preformed structural elements. The low cost of materials and the ability to erect structures utilizing the efforts of local, unskilled labor responds to existing immediate needs for housing and other building facilities.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention:

1. Means for assembling a building, for human occupancy, of preformed structural modules comprising in combination, on a plot of earth with a defined building grade level;

a column structural module for resisting vertical and lateral forces encountered in a building of a size suitable for human occupancy and utilizing said column, said column having a longitudinal axis and a base configured for supporting said column with said base below grade level in said earth;

a beam structural module for establishing a load hearing structural element for a building of a size suitable for human occupancy and utilizing said beam, said beam having a longitudinal axis;

said column and said beam each being performed and having complementary interlocking, mating configurations such that, when said column and said beam are interlockingly, matingly coupled by juncture of said complementary interlocking configurations, the longitudinal axis of said beam will be constrained to be generally orthogonal to the longitudinal axis of said column, said beam being interlocked with said column and said beam is a footer beam for establishing a load bearing footing for a building utilizing said beam, said footer beam configured for load bearing in said earth below said grade level;

a plurality of said columns and a plurality of said footer beams, each of said footer beams having a first end and a second end;

a first end of a first said foot beam being coupled below said grade level in said earth to a first said column adjacent the second end of a second said footer beam also coupled to said first column, also below grade level in said earth;

all said columns and said footer beams being so coupled so as to define a first enclosed area on said plot of earth;

each said column and said footer beam being coupled by juncture of said complementary interlocking mating configurations, whereby the longitudinal axis of each said footer beam is constrained to form aright angle with the longitudinal axis of said column to which said footer beam is coupled, by virtue of the mating of said complementary interlocking mating configurations;

a header beam structural module for establishing an overhead, load bearing header for a building utilizing said header beam, said header beam having a longitudinal axis;

said header beam being preformed and having a interlocking mating configuration complementary to said interlocking mating configuration of said column such that when said column and said header beam are matingly interlockingly coupled by juncture of said complementary mating configurations, the axis of said header beam will be constrained to be generally orthogonal to the axis of said column, said header beam being interlockingly coupled to said column;

a plurality of said header beams, each of said header beams having a first end and a second end;

a first end of a first said header beam being coupled to a first said column adjacent the second end of a second said header beam also coupled to said first column;

all said columns and said header beams being so coupled so as to define a second enclosed area;

each said column and said header beam being coupled by juncture of said complementary interlocking configurations, whereby the longitudinal axis of each said header beam is constrained to form a right angle with the longitudinal axis of said column to which said header beam is coupled, by virtue of the interlocking of said complementary interlocking configurations;

a ceiling/roof structural module, said ceiling/roof structural module being coupled to at least one of said header beams and having complementary interlocking configurations to permit said ceiling/roof structural module to be coupled matingly with an adjacent ceiling/roof structural module;

a plurality of said ceiling/roof modules coupled to said header beams about the periphery of said second enclosed area, each said ceiling/roof module being further coupled to a ceiling/roof module adjacent to it;

said plurality of ceiling/roof modules, so coupled, defining a roof covering said second enclosed area;

said second enclosed area further defining a horizontal plane when said columns are vertical, by virtue of the interlocking of all said complementary mating configurations made between columns and header beams, ceiling/roof modules and header beams, and adjacent ceiling/roof modules; and a wall enclosure module configured for mating coupling with said complementary interlocking configurations of said columns, footers, and headers;

said wall enclosure module being matingly coupled to at least one of said header beams.

2. The means of claim 1 further comprising:

a floor structural module, said footer beams being configured to couple interlockingly with said floor structural module, said floor structural module being interlockingly coupled above said grade level to at least one of said footer beams and having further complementary mating configurations to permit said floor structural module to be coupled interlockingly with an adjacent floor structural module.

3. The means of claim 2 further comprising:

a plurality of said floor structural modules coupled to said footer beams about the periphery of said first enclosed area and above said grade level, each said floor module being further coupled to a floor structural module adjacent to it, said plurality of floor structural modules, so coupled, defining a floor covering said first enclosed area, said floor further defining a horizontal plane when said columns are vertical, by virtue of the mating of all said complementary mating configurations made between columns and footer beams, floor structural modules and footer beams, and adjacent floor structural modules.

4. The means of claim 1 further comprising:

a plurality of said wall enclosure modules each matingly coupled to one of said header beams and to one of said footer beams, said plurality of said wall enclosure modules defining a closed volume of space bounded top and bottom by said roof and said floor, each said wall enclosure module being constrained to lie in a plane perpendicular to the plane of said floor by virtue of the interlocking of said complementary mating sections.

5. A method for assembling a building, of a size suitable for human occupancy, of preformed structural modules comprising the steps of:

selecting a plot of land as a building site for said building;

establishing the grade level at which said building will be assembled on said building site;

providing a column structural module for resisting vertical and lateral forces encountered in said building, said column having a base and a longitudinal axis;

providing a beam structural module for establishing a load bearing structural element for said building, said beam having a longitudinal axis;

wherein the steps of providing said column and said beam structural modules include the steps of preforming and configuring said column and said beam with complementary interlocking, mating configurations;

setting said base of said column below said grade level of said building site with said longitudinal axis of said column generally vertical;

interlockingly, matingly coupling said column and said beam by joining said complementary interlocking configurations, and, causing, by said joining of complementary interlocking configurations, said longitudinal axis of said beam to be generally orthogonal to said longitudinal axis of said column;

using said beam as a load bearing footer beam for said building;

placing said footer beam on said building site as dictated by said grade level established on said building site;

providing a plurality of said columns and a plurality of said footer beams, each of said footer beams having a first end and a second end;

coupling a first end of a selected first said footer beam to a selected first said column;

coupling a second end of a selected second said footer beam to said selected first said column, adjacent said first end of said selected first said footer beam;

coupling all said columns and said footer beams thereby defining a first enclosed area, coupling each said column and said footer beam by joining said complementary interlocking mating configurations;

causing, by said joining of said complementary interlocking mating configurations, the longitudinal axis of each said footer beam to form a right angle with the longitudinal axis of said column to which said footer beam is coupled;

providing a header beam structural module as an overhead, load bearing header for said building, said header beam having a longitudinal axis;

preforming and configuring said header beam with an interlocking mating configuration complementary to said interlocking mating configuration of said column;

interlockingly matingly coupling said column and said header beam by joining said complementary mating configurations, causing the axis of said header beam to be generally orthogonal to the axis of said column;

providing a plurality of said header beams, each of said header beams having a first end and a second end;

coupling a first end of a selected first said header beam to a selected first said column;

coupling a second end of a selected second said header beam to said selected first said column adjacent said first end of said selected first said header beam;

coupling all said columns and said header beams so as to define a second enclosed area, coupling each said column and said header beam by joining said complementary interlocking configurations, causing, by said coupling, said longitudinal axis of each said header beam to form a right angle with the longitudinal axis of said column to which said header beam is coupled;

providing a ceiling/roof structural module.

coupling said ceiling/roof structural module to at least one of said header beams by providing said ceiling/roof structural module with complementary interlocking configurations, and causing said ceiling/roof structural module to be coupled matingly with an adjacent ceiling/roof structural module, when an adjacent ceiling/roof structural module is provided;

providing a plurality of said ceiling/roof modules and interlockingly coupling a selected one of each to a selected one of said header beams about the periphery of said second enclosed area;

further coupling each said ceiling/roof module to a ceiling/roof module adjacent to it, forming a roof, covering said second enclosing area;

said interlocking of all said complementary mating configurations made between columns and header beams, ceiling/roof modules and header beams, and adjacent ceiling/roof modules further defining a horizontal plane when said columns are vertical;

providing a performed wall enclosure module and configuring it for mating coupling with said complementary interlocking configurations of said columns, footers, and headers; and matingly coupling said wall enclosure module to at least one of said header beams.

6. The method of claim 5 further comprising the steps of:

providing a floor structural module, further configuring said footer beams to couple interlockingly with said floor structural module, interlockingly coupling said floor structural module to at least one of said footer beams, and providing said floor structural module with complementary mating configurations to permit said floor structural module to be coupled interlockingly with an adjacent floor structural module when an adjacent floor structural module is provided.

7. The method of claim 6 further comprising the steps of:

providing a plurality of said floor structural modules and coupling a selected one of each to a selected one of said footer beams about the periphery of said first enclosed area, further coupling each said floor structural module to a floor structural module adjacent to it, forming a floor, covering said first enclosed area, the interlocking coupling of all said complementary mating configurations, made between columns and footer beams floor structural modules and footer beams, and adjacent floor structural modules, defining a horizontal plane when said columns are vertical.

8. The method of claim 5 further comprising the steps of:

providing a plurality of said wall enclosure modules each matingly coupled to one of said header beams and to one of said footer beams, using said plurality of said wall enclosure modules to define a closed volume of space bounded top and bottom by said roof and said floor, causing each said wall enclosure module to lie in a plane perpendicular to the plane of said floor by virtue of the interlocking of said complementary mating sections.

9. The method of claim 5 further comprising the step of incorporating a structural wall unit into said wall enclosure module.

10. The method of claim 5 further comprising the step of incorporating a window wall unit into said wall enclosure module.

11. The method of claim 5 further comprising the step of incorporating a door unit into said wall enclosure module.

12. The method of claim 5 further comprising the step of providing said wall enclosure module as a combination of a structural wall unit, a window wall unit, and a door unit.

* * * * *